United States Patent [19]

Chaussé et al.

[11] Patent Number: 4,587,392

[45] Date of Patent: May 6, 1986

[54] ELECTRO-MAGNETIC INDUCTION SCROLLING DEVICE FOR HEATING FLAT PRODUCTS

[75] Inventors: Bernard Chaussé, Antony; Jean Delassus, Montmorency; Claude Léon, Le Bourget, all of France

[73] Assignee: CEM - Compagnie Electro-Mecanique, Paris, France

[21] Appl. No.: 692,141

[22] Filed: Jan. 17, 1985

[30] Foreign Application Priority Data

Jan. 26, 1984 [FR] France ..... 84 01187

[51] Int. Cl.[4] ..... H05B 6/40

[52] U.S. Cl. ..... 219/10.71; 219/10.43; 219/10.57; 219/10.75; 219/10.79; 219/10.61 R

[58] Field of Search ..... 219/10.41, 10.43, 10.61 R, 219/10.57, 10.49 R, 10.79, 10.69, 10.71, 10.75, 10.77

[56] References Cited

U.S. PATENT DOCUMENTS

| | | | |
|---|---|---|---|
| 2,448,012 | 8/1948 | Baker | 219/10.61 |
| 3,965,321 | 6/1976 | Brinkmann et al. | 219/10.41 |
| 4,321,444 | 3/1982 | Davies | 219/10.79 X |
| 4,484,048 | 11/1984 | Travers et al. | 219/10.79 X |
| 4,518,840 | 5/1985 | Bronner | 219/10.41 X |

FOREIGN PATENT DOCUMENTS

| | | |
|---|---|---|
| 884811 | 6/1953 | Fed. Rep. of Germany . |
| 1158194 | 11/1963 | Fed. Rep. of Germany . |
| 1202900 | 1/1960 | France . |
| 1347484 | 11/1963 | France . |

*Primary Examiner*—Philip H. Leung

*Attorney, Agent, or Firm*—Sughrue, Mion, Zinn, Macpeak, and Seas

[57] ABSTRACT

As known the product to be heated (7) is made to scroll longitudinally in the flow of an inductor (IC) with a dual frequency along a longitudinal pitch and along a transverse pitch. According to the invention this produce is made to scroll in the flow of two successive inductors with a common transverse pitch (PT) which is adjustable (31*a*) practically between the two longitudinal pitches of these two inductors, this transverse pitch is set to make the width of this product coincide with an integer number of transverse pitches thus obtaining the same heating on the two edge areas (*7a, 7b*) of this product as on the intermediate areas, and firstly the ratio of the currents supplying these two conductors is set to homogenize the heating in each transverse pitch, and secondly the total power adjusted to reach the temperature required. The invention applies to metallurgy.

5 Claims, 16 Drawing Figures

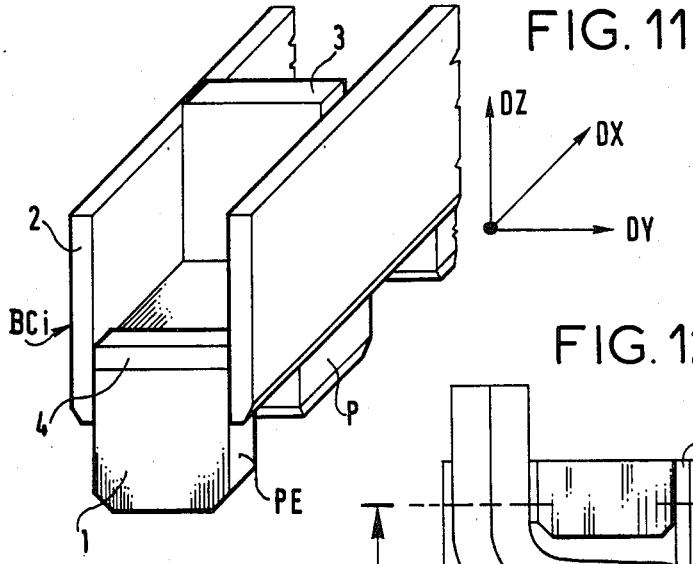
FIG. 11
FIG. 12
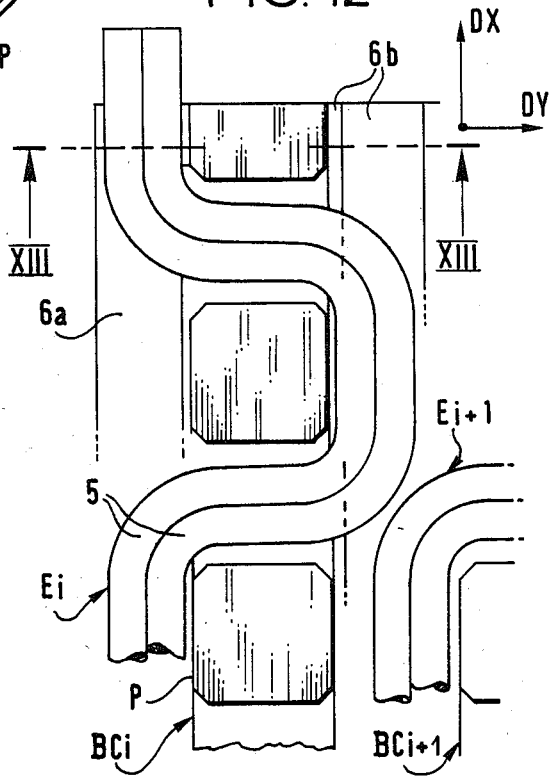
FIG. 13
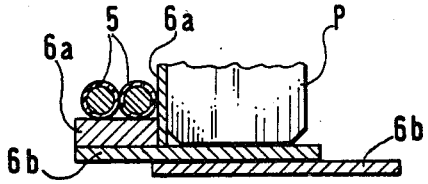

ELECTRO-MAGNETIC INDUCTION SCROLLING DEVICE FOR HEATING FLAT PRODUCTS

BACKGROUND OF THE INVENTION

The invention concerns the heating of electrically conductor flat products, this heating being obtained by scrolling through electromagnitude induction. A known device employed for this contains the following essential components:

A transfer system keeping the flat product to be heated in a heating plane and scrolling it along a longitudinal transfer direction in this plane. The width of the product is laid in a transverse direction also in this plane and its thickness in a direction of flow, each of these directions being perpendicular to others. The transverse position of the product to be heated can be adjusted.

Inductor excitation windings.

Electricity supply sources to supply these windings with an electric current periodically variable according to the time and with controlable amplitude, so that they thus produce a magnetic flow varying like this current.

And magnetic inductor circuit to channel this flow and form a heating flow through the product to be heated more or less along the said direction of flow.

The invention applies to the frequent case where heating must be homogeneous over the whole surface of the product.

Amongst the devices known to obtain this heating, most of them use a magnetic field whose profile is uniform over the greater part of the width of the product. This profile is corrected on the edges to obtain homogeneous heating over the whole width by organizing the distribution of the closing currents. The homogeneity along the lengths results from the longitudinal scrolling of the product.

This is notably the case in the British Pat. No. 1546367. The corrections to the edges are obtained by various devices (coils, or additional magnetic bridges, air-gap modifications, . . . ) which complicate the construction and must be adapted to the induced reaction of the product, this reaction depending on the latter's characteristics: thickness, resistivity.

Another known device said to be "sqaure mesh" does away with the above difficulties. It is described in the document No. FR-A 2538665 (the French Pat. No. EN 82 21906 of Dec. 28, 1982). The inductor consisting of windings and magnetic circuits obtains square meshing of the heating flow with a sinusoidal distribution of the magnetic field along the two directions parallel to the sides of the squares. If the product has a width containing an integer number of times the pitch of the meshing, heating is then homogeneous without any correction to the edges. However if the width of the product does not contain an integer number of times the pitch of the meshing, a heterogeneous temperature develops on the two edges. To reduce this heterogeneity it is possible firstly to modify the excitation current of the meshing elements opposite these edges, secondly to provide a relatively small meshing pitch so that the heat difused by conduction provides acceptable homogenization in this area. However a small pitch of the meshing may be a handicap given that the inductible surface capacity varies in the same way as the fourth power of this pitch, without so much ensuring a sufficient homogenization through conduction in the product if the scrolling speed is relatively high (short transfer time). Additional inductors can thus be added opposite the edges, but this introduces the constructional complexity indicated above.

SUMMARY OF THE INVENTION

The device according to the invention contains the essential components referred to above. Its inductor has a periodical composition both in the longitudinal direction with a longitudinal pitch and in the transverse direction with a transverse pitch, so that the variations in the amplitude of the heating flow in the heating plane outline a rectangular meshing consisting of the juxtaposition of rectangular squares of length equal to this longitudinal pitch and widths equal to this transverse pitch. The magnetic circuit contains in each of these squares at least one central polar part such that the amplitude of the heating flux is cancelled out on the sides of the squares so that the average heating obtained after scrolling of the product to be heated is the same over all the widths of the square comprised entirely in the width of this product. The form of this part is further chosen so that this amplitude is maximum in the center of the square with a more or less sinusoidal arch distribution both in the longitudinal sections and in the transverse sections. The ratio of the transverse pitch to the longitudinal pitch is selected to cancel out the local heating heterogeneity in each of the squares which are entirely contained in the width of the products to be heated. This local heterogeneity is the difference in one direction in the other of the temperature in the center of the width of the square to that of the edges of the square after the product has scrolled.

The inventors have observed that this local heterogeneity develops on output from an inductor when its real transverse pitch diverges from an equilibrium value similar to the longitudinal pitch of this inductor, this heterogeneity then increasing firstly with the divergence from this equilibrium value and secondly with the current supplying this inductor.

A rectangular meshing is described in the application for the French patent referred to above which nevertheless only envisages that the ratio of the transverse pitch to the longitudinal pitch be equal to one, given that the meshing proposed in square as indicated above.

One could conceive of producing, but with very great complexity and with prohibitive costs, a setting of the pitch of a square meshing, in both directions so as to adapt exactly to all the widths of the family of products to be heated.

The aim of the invention is to provide for homogeneous heating of a product of any width without any special correction of the edge and using a device with acceptable production costs.

The device according to this invention is featured by the fact that it contains a first and a second so-called inductor succeeding each other longitudinally, and having respectively a first and a second value different from the longitudinal pitch, and consequently a first and a second equilibrium value of the transverse pitch.

Each of these inductors consist of the juxtaposition of several inductor sections in succession transversally and regularly according to the said transverse pitch, each of these sections extending longitudinally and with its own inductor winding and its own magnetic circuit, and offering the said frequency according to the longitudinal pitch.

Mechanical setting facilities control the spacing between the said inductor sectors consequently the said transverse pitch to the same value in these two inductors. This adapts the device to limited variations in the width of the product to be heated through a variation in this spacing and making this width equal to an integer number of transverse pitches. It is thus possible to have the edges of the products coincide with the edges of the said squares in each conductor, so as to heat the edge areas of this product to the same temperature as its intermediate areas. The common transverse pitch can be controlled between the said first and second equilibrium values of the transverse pitch.

Electrical setting facilities control the ratio of the electric circuits supplying the two inductors. When a difference between the real transverse pitch and its equilibrium value in each conductor tends to produce a said local heterogeneity in the heating specific to this inductor, these setting facilities supply the two inductors with the electrical currents necessary to cancel the local global heating heterogeneity of the device through compensation between the two heterogeneities specific to the two inductors.

In short it would appear that, to remain within acceptable costs, a configuration is adopted according to the invention, varying only in width, so as to always have an integral number of transverse pitches in this width, the device then containing two inductors whose two longitudinal pitches define, with the preceding common transverse pitch, two rectangular meshings. The long side of the rectangle is in the direction of the transfer of one of the inductors and in the direction perpendicular to the transfer for the other inductors. By setting the ratio of the excitation currents in the two inductors it is thus possible to obtain an exact compensation of the heterogeneities created by one inductor by equal sized heterogeneities with opposing sign and created by the other inductor.

Preferably the magnetic circuit of each of the said sectors contains at least one longitudinal bar carrying the said polar parts succeeding each other longiudinally and projecting towards the product to be heated. A winding specific to this bar follows a winding path passing longitudinally in line with a first polar part, then transversally between this part and a second one, then longitudinally to the left of this second one, then transversally between this second one and this third, and so on. In this way the inductor sector is easily produced.

Moreover it is advantageous that the device should also comprise electrical switches so as to connect or disconnect the windings exciting the lateral sectors of the two inductors thus varying the number of transverse pitches to adapt the width of the heating flow to variations in the width of the product to be heated larger than the aforesaid limited variations.

Also each sector should preferably contain two of the said bars installed on either side of the product to be heated.

A further aim of this invention is a heating process for flat products scrolling through electro-magnetic induction, according to which the product to be heated is made to scroll longitudinally in the flow of an inductor offering a dual frequency according to a longitudinal pitch and a transverse pitch, featured by the fact that this product is made to scroll in the flow of two successive inductors with a common transverse pitch which is practically adjustable between the two longitudinal pitches of these two inductors, this transverse pitch is adjusted so that the width of this product coincides with an integer number of transverse pitches thus obtaining the same heating on the two edge areas of this product as on the intermediate areas; firstly the ratio of the currents supplying the two inductors is said to homogenize the heating in each transverse pitch, and secondly the total power adjusted to reach the temperature required.

The advantages and specific features of the invention will be better understood on reading what follows, illustrated by the figures appended.

BRIEF DESCRIPTION OF THE DRAWINGS

FIG. 11 shows a perspective view and end portion of a bar.

FIG. 12 shows the detail, at magnified scale, of FIG. 8 to display the relative arrangement of the parallel parts and windings.

FIG. 13 shows a cross-sectional view of an inductor section showing a polar part according to a drawing X11 in FIG. 12.

DESCRIPTION OF THE PREFERRED EMBODIMENT

The inventors have established that if the meshing is rectangular instead of being a square, the heating heterogeneity in a transverse pitch has a sinusoidal distribution whose DT amplitude is given more or less exactly by the expression:

$$DT=T.(1-a^2/b^2)/(1+a^2/b^2)$$

If T designates the mean temperature obtained, a the short side b the long side of the rectangle.

Figure 1:
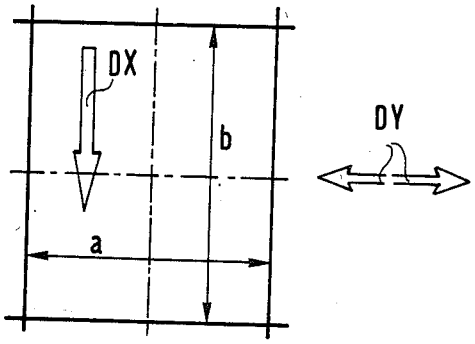
FIG. 1 shows a square of rectangular magnetic meshing with its long side in the direction DX of the transfer.
Figure 2:
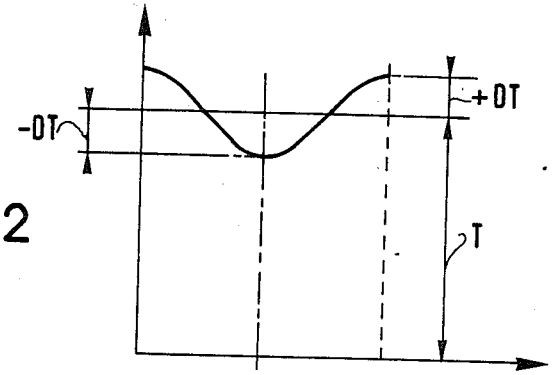
FIG. 2 shows the heterogeneity of the heating obtained in the width of the product scrolling in the square in FIG. 1, the temperature reached by the various points in this width being entered in ordinates.

If, in accordance with FIG. 1, side a is installed over the width of the product (transverse direction DY) and side b the direction of the transfer DX, the maxima of the sinusoid or superheats is on the edges of the rectangles and the minima or underheats in the axis of the said rectangles, as in FIG. 2.

Figure 3:
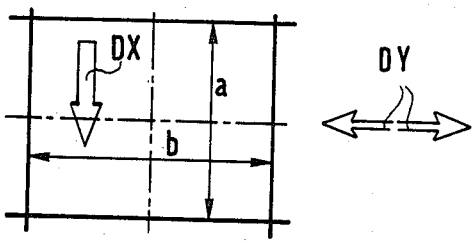
FIG. 3 shows a square with rectangular meshing with its long side in a transverse direction DI perpendicular to the direction of the transfer.
Figure 4:
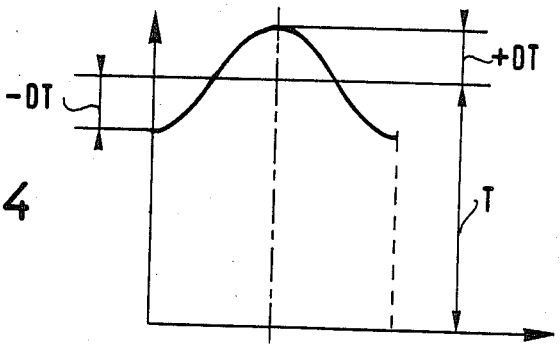
FIG. 4 shows the heterogeneity of the heating obtained in the width of the product scrolling opposite the square in FIG. 3.

If, in accordance with FIG. 3, a is installed in the direction of the transfer DX and b over the width of the product, the maxima of the sinusoid or superheats are in the axis of the rectangles and the minima or underheats on the edges of the rectangles as shown on FIG. 4.

In the device according to the invention, the basic configuration consists of two furnaces with respectively two inductors IL and IC one of which forms a meshing of longitudinal pitch PL and the other a meshing of longitudinal pitch PC. These two pitches are fixed constructively.

In the transverse direction DY, i.e., in the width of the product, the meshing has a variable pitch PT. This variable pitch PT is comprised between the longitudinal pitches PL and PC and it should be contained an integer n times in the width LA of the product LA=n PT.

Take the specific case in which PL/PT=PT/PC.

The heating heterogeneities are in this case of the same amplitude in both furnaces if they are excited equally, so as to each induce half the total heating power, but have the configuration of FIG. 2 in the PL pitch furnace, and the configuration of FIG. 4 in the PC pitch furnace, so that they compensate each other exactly.

Figure 5:
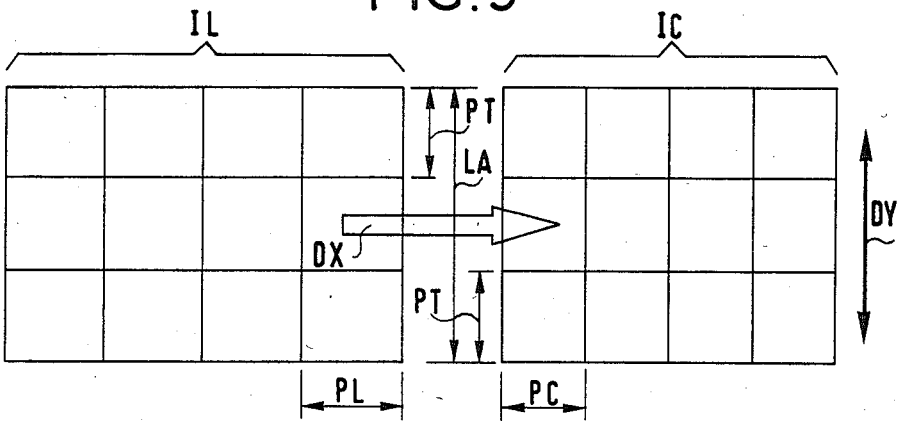
FIG. 5 shows the meshings of the heating flows created by inductors IL and IC of two furnaces which follow each other in the direction of transfer, when these meshings are such that the two furnaces must be used at the same power, which implies that the meshing rectangles in the two furnaces have practically the same length to width ratio.

This meshing is shown in FIG. 5.

For all the cases in which the width of the product is between n.PL and n.PC, it is also possible to obtain homogeneous heating. Having installed as previously, an integer number n of pitch PD in the width of the product, the two furnaces are excited differently so as to demand more power from the one producing the least heterogeneity for a given current, and vice versa. The two limit cases are shown in FIGS. 6 and 7.

Figure 6:
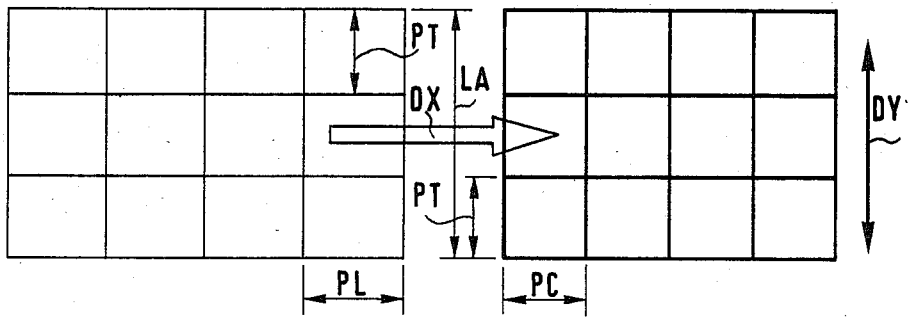
FIGS. 6 and 7 show meshings of the two same furnaces after reduction and increase in the transverse pitch so as to produce a square meshing in the first and second furnaces, respectively, a thick line indicating the only furnace supplied electrically and which has the square meshing.

On FIG. 6, the width of the product is n.PC. One of the furnaces then has a square mesh, producing heating free of heterogeneity. Full power is therefore required of this one whereas the second furnace is not used.

Figure 7:
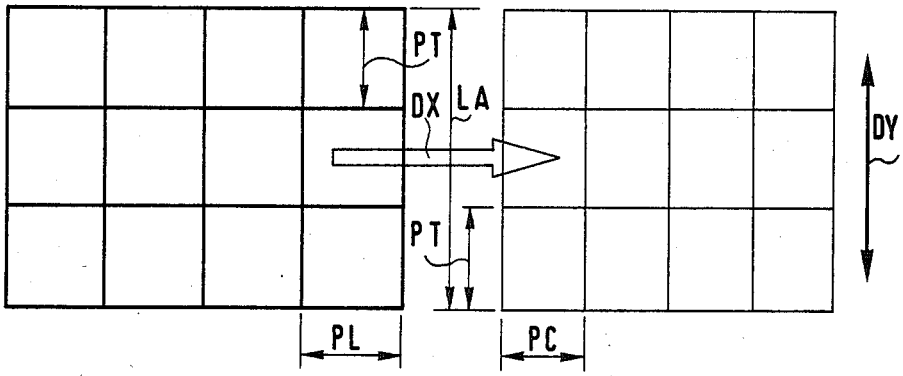

On FIG. 7, the width of the product is n.PL. The unused furnace in the case above becomes square mesh and it is now this one for which full power is required, free of heterogeneity, whereas the other furnace is not used.

In practice, so as to limit the underuse of these two extreme cases, thus to obtain more favorable and economic sizing, no furnace is unused, but with a lower load than that with rectangular meshing so that the heating heterogeneity remains compatible within the accepted tolerance.

Figure 14:
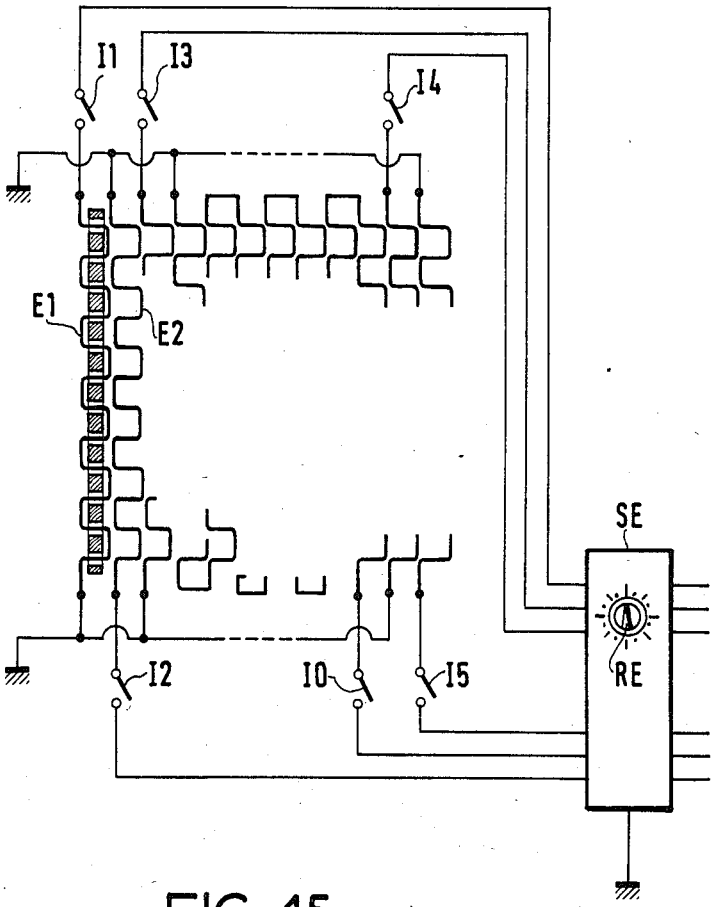
FIG. 14 shows a connection diagram of the excitor windings of an inductor, to show that the windings of several lateral sections can be disconnected to adapt to the width of the product to be heated.

If the width of the product is less than n.PC, k longitudinal sections are disconnected from the above meshing in the width of the product, k being determined by the shortest foreseable width of product to be heated, obtained by opening switches such as I1, I1 (see FIG. 14).

Figure 8:
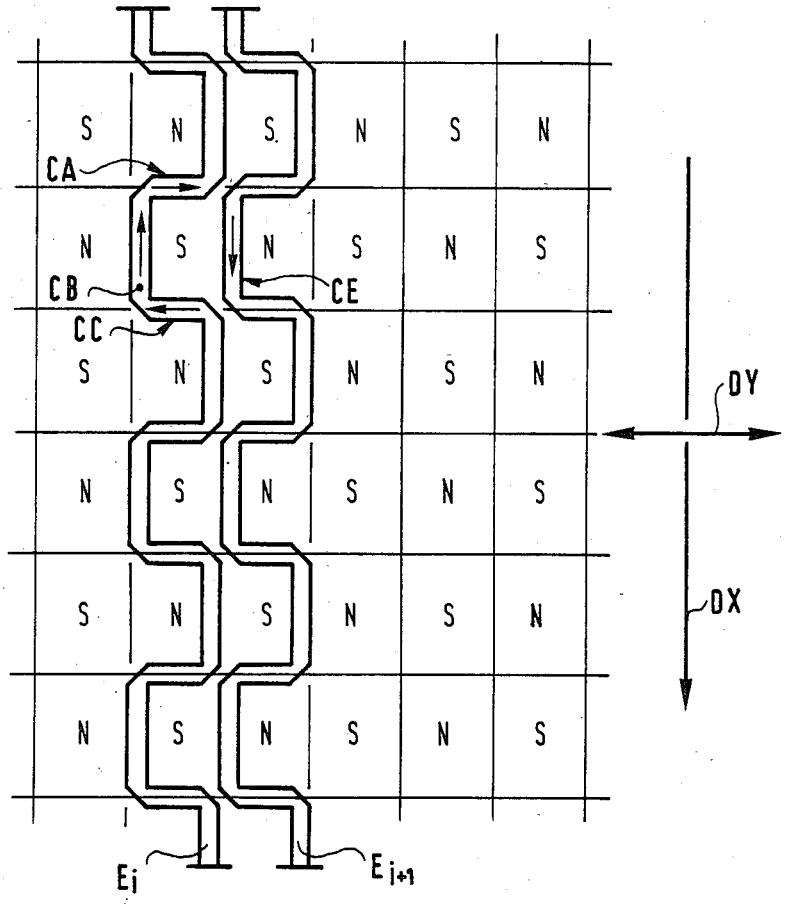
FIG. 8 shows a front view of the inductor of one of these furnaces, displaying the principle of coiling the inductor windings, the north and south magnetic poles being designated by the letters N and S respectively.

It is clear that, given that only the transverse pitch is variable, it is possible to make all the meshes in the same section indissociable from each other. Windings Ei, Ei+1 shown in FIG. 8 belong to two successive sections of rank i and i+1. Their form is linked to this indissociability. The electrical conductor takes on the form of an undulation around the alternating N and S poles in the same row determining three of the four sides CA, CB and CC of a rectangular helix. This same figure shows that the fourth side CE of the helix consists of an conductor of the adjacent sector, owing to the directions of currents indicated, without preventing the relative displacement of the first section in relation to the second so as to vary the transverse pitch.

It can nevertheless be observed that, when the transverse pitch diverges from its minimum value, a perfectly closed rectangular current helix cannot be exactly obtained because two no current intervals remain in the two transverse sides of the rectangle. In particular, when the transverse pitch is equal to the longitudinal pitch one does not obtain exactly the square current helix which would obtain perfectly homogeneous heating. This is one of the reasons for which the said equilibrium value of the transverse pitch is not exactly equal to the longitudinal pitch, this equilibrium value being that by which in practice we get as close as possible to homogeneous heating, and being determined experimentally.

To take a concrete example, the problem is to heat up to 480° C. strips of aluminium 1 mm thick scrolling at a speed of 0.33 m/s and whose width is between 0.85 and 1.85 m. 800 kW must be induced for the maximum width.

Figure 9:
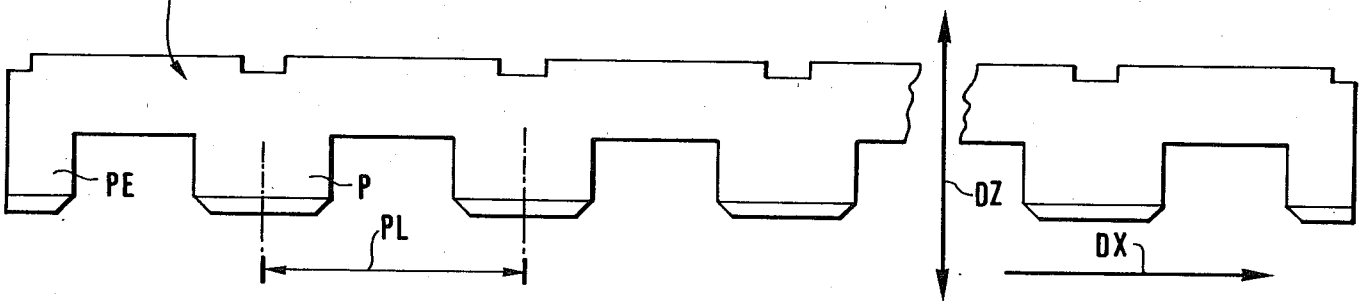
FIGS. 9 and 10 show, in a side view, the magnetic circuits with fixed longitudinal pitches different from the second and first inductors respectively.
Figure 10:
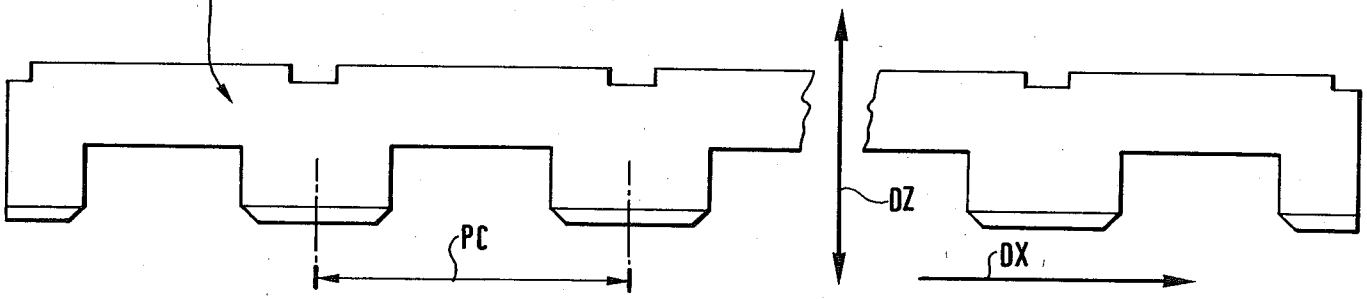

The two furnaces are produced one with a longitudinal pitch of 170 mm according to FIG. 9, the other with a longitudinal pitch of 240 mm according to FIG. 10. Each longitudinal row of meshings materialized by an inductor sector with a magnetic circuit in bar form. The polar parts or pole pieces are shown in P. The extreme longitudinal polar parts PE have half the length.

In both cases, each bar consists of a bed of magnetic plates 1, clamped between flanges 2 and braced by parts 3 and 4 as shown in FIG. 11. The winding associated to a bar is shown in FIG. 12. The conductor consists of two copper tubes 5, outside diameter 25 mm, and inside diameter 19 mm, connected parallel and winding around the poles as previously explained.

FIG. 13 is a cross-sectional view of a bar and also shows the insulating shims both electrical *6a* and thermal *6b*.

FIG. 14 shows the principle governing the electrical connection of one of the inductors. The minimum width of 850 mm is covered by five transverse pitches of 170 mm. To impose a nil value on the magnetic field on the two edges of the product, two additional sections are excited outside the product, one on each edge. These seven sections each forming a row of poles, are supplied through a switch Io which is only opened when the inductor is not in service.

By varying the seven pitches thus defined from 170 to 204 mm, the five active pitches heat all the widths between 850 and 1020 mm.

Adding an eighth row, by closing switch 13 six active pitches can be used heating all the widths between 1020 and 1190 mm when these pitches vary from 170 to 198.33 mm.

WIth the addition of a ninth row (switch 14 closed), it is possible with seven active pitches, to heat all widths between 1190 and 1360 when these pitches vary from 170 to 194.28 mm.

And so on enabling widths to be heated up to 1700 to 1870 mm by evolution of 12 transverse pitches, ten of them active from 170 to 187 mm.

ALong the same principle the following could also be produced:

7 transverse pitches varying from 170 to 204, five of them active, width heated 850 to 1040 mm 8 transverse pitches varying from 170 to 204, six of them active, widths heated 1040 to 1224 mm 9 transverse pitches varying from 170 to 204, with seven of them active, widths heated 1224 to 1428 mm 10 transverse pitches varying from 170 to 204, with eight of them active, widths heated 1428 to 1632

11 transverse pitches varying from 170 to 204, nine of them active, widths heated 1632 to 1836 mm 12 transverse pitches varying from 170 to 204, ten of them active, widths heated 1836 to 2040 mm.

The second device has the advantage of heating larger widths than the first. Nevertheless, for the maximum width of 1850 mm considered, the first device, not using for the large widths the full variation in the transverse pitch, means that with these large widths, the total power is better distributed between the two furnaces thus minimizing the power installation, without however using an additional row.

This example is not exhaustive as to the method of electrical connections. It is basically an illustration. In practice it is advantageous in certain cases to use parallel connections. The power supply voltages are selected to obtain the same current in the windings of the same inductor. The said current setting mechanisms are incorporated into source SE.

Figure 15:
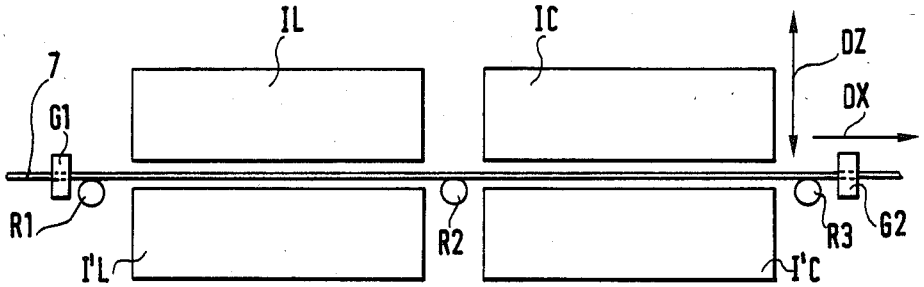
FIG. 15 shows a side view of the device, according to the invention, displaying the system of transferring the product to be heated scrolling horizontally.

According to FIG. 15 the system of transferring the product to be heated seven consists of rollers R1, R2, R3 providing for horizontal scrolling, the product being supported inside the furnaces either by the mechanical tensions applied between the inlet and outlet or, if a product is not ferromagnetic, by the magnetic levitation indissociable from the product (see for example document No. FR-A 2509 562). In this latter case, the rollers R1, R2 and R3 can be suppressed, which is advantageous if the product should not be in contact during its treatment. Each furnace contains two inductors symmetrical to the plane of the product to be heated. These long pitch inductors are shown in IL and I'L, the short pitches ones in IC and I'C. The adjustable lateral guides G1, G2 provide the transverse positioning of the product.

Figure 16:
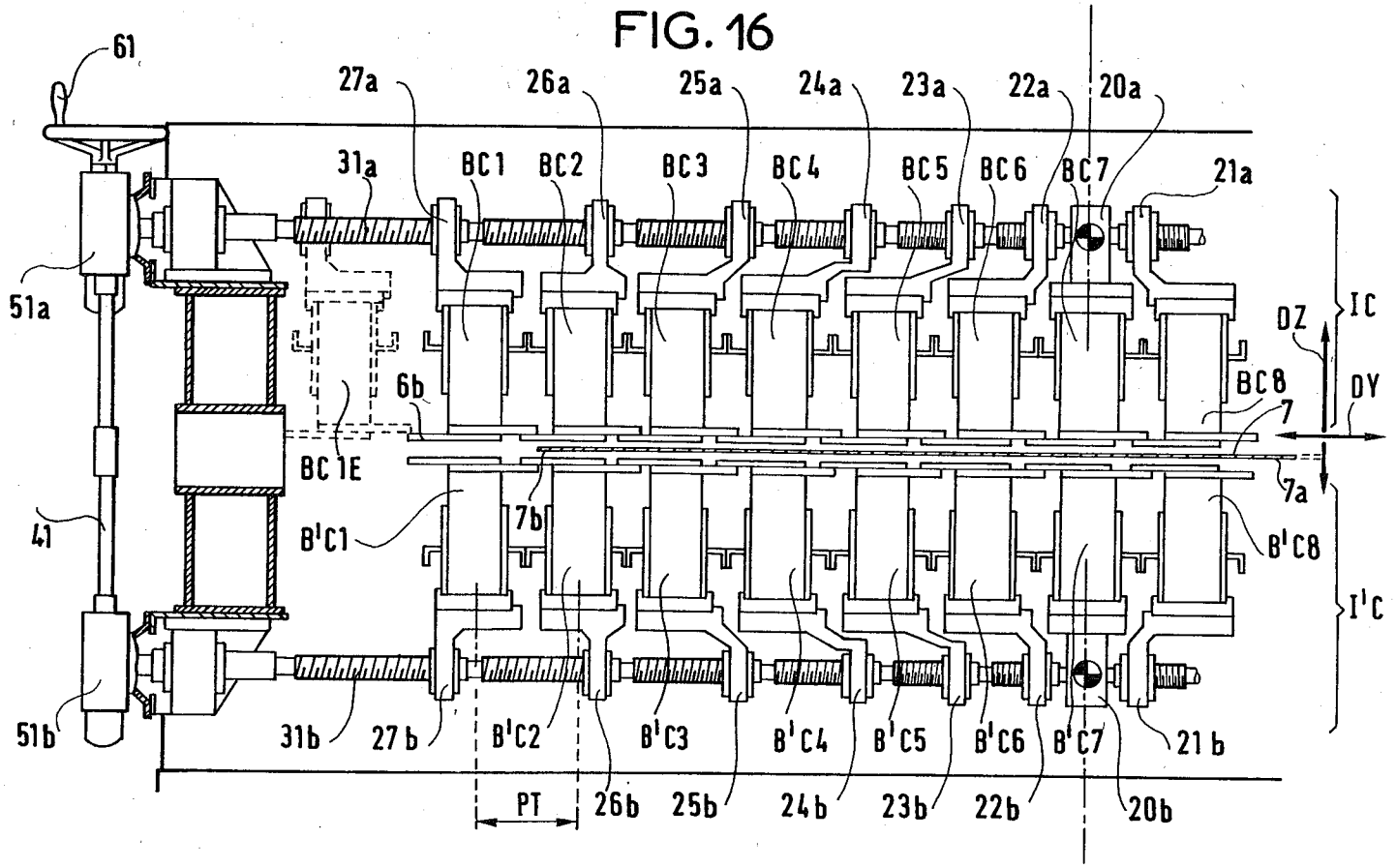
FIG. 16 shows a cross-section of the view of the short inductor in the device (see FIG. 15), displaying the mechanism setting the transverse pitch.

FIG. 16 shows the solution adopted in the example to obtain the variations in the transverse pitch. It is the cross-section of one of the two furnaces and only shows a half-width the other practically being symmetrical. The furnace is shown in the configuration corresponding to the minimum value of the transverse pitch.

The inductor bars BC1 to BC13 and B'C1 to B'C13, designed as described above and shown in FIGS. 9 to 13, are carried by moving supports 21*a* to 27*a*, 21*b* to 27*b*, except for bars 10*a* and 10*b*, identical to the others, which are carried by fixed supports 20*a* and 20*b*.

Moreover 21*a* and 27*b* are moving and rotated by two screws 31*a* and 31*b*, guided radially by guides 20*a* and 20*b*, the pitch of the threads being 2 mm for supports 22*a* and 22*b*, and also for 21*a* and 21*b*, 4 mm for supports 23*a* and 23*b*, 6 mm for supports 24*a* and 24*b*, 8 mm for supports 25*a* and 25*b*, 10 mm for supports 26*a* and 26*b*, and 12 mm for supports 27*a* and 27*b*. Guides which are not shown preserve the parallelism of the supports.

The configuration is practically symmetrical in relation to the fixed supports 20*a* and 20*b*, except that the part not shown contains five pairs of moving bars (whereof 21*a* and 21*b*) instead of six.

The two screws 31*a* and 31*b* are controlled by the same mechanism comprising, on the same shaft 41, two bevel gears 51*a* and 51*b* and a hand-wheel 61.

The product to be heated 7 moves between the bars 11*a* to 17*a* and 11*b* to 17*b* perpendicular to the plane in the figure.

The dotted line shows the extreme position BCIE of bar BCI after rotation of screws 31*a* and 31*b* to obtain the maximum transverse pitch value.

We claim:

1. Device for heating flat products, scrolling, through electro-magnetic induction, said device comprising:

a transfer system (R1, R2, R3, G1, G1) holding the flat product to be heated (7) in a heating plane and scrolling it along a longitudinal transverse direction (DX) in said plane, said product being arranged in width along a transverse direction (DY) also in said plane and having its thickness along a direction of flow (DZ), each of said three directions being perpendicular to the two others, the transverse position of the product to be heated being adjustable;

inductor excitation windings (E1, E1, Ei, Ei+1);

electric power sources (SE, Io, I1, I3, I4, I5) supplying said windings with an electric current periodically variable according to time and with amplitude control such that the alternating current in the inductors creates a magnetic alternating flux, the amplitude of which varies like the amplitude of said current;

and inductor magnetic circuits (BCi) channeling said magnetic flux and inductively heating the product to be heated along the direction of magnetic flux;

said windings and said magnetic circuits forming an inductor (IC) have a periodical spatial composition both along the longitudinal direction with a longitudinal pitch (PC) and along the transverse direction with a transverse pitch (PT), so that the variations in the amplitude in the magnetic flux causing heating in the heating plane outline a rectangular meshing consisting of a juxtaposition of rectangular squares of lengths equal to said longitudinal pitch and widths equal to said transverse pitch, and said magnetic circuits containing in each of said squares at least one central pole piece (P) such that the amplitude of the heating magnetic flux cancels out on the sides of the square so that the average heating obtained after scrolling of the product to be heated is the same in all the widths of a square comprised entirely in the width of said product, the form of said central pole piece being further such that said amplitude is maximum in the center of the square with distribution more or less in sinusoid arch form both in the longitudinal sections and the transverse sections, and the ratio of the transverse pitch to the longitudinal pitch being selected to cancel out the local heterogeneity of heating in each of the squares which are entirely contained in width (LA) of the product to be heated, said local heterogeneity (DT) being the divergence in one direction or the other from the temperature in the center of the width of the square as compared to that of the edges of the square after scrolling of said product, said local heterogeneity developing on output from an inductor when its real transverse pitch diverges from an equilibrium value similar to the longitudinal pitch of said inductor, and said heterogeneity increasing firstly with the divergence of said equilibrium value and secondly with the current supply in said inductor;

said device containing a first inductor (IL) and a second inductor (IC), said inductors succeeding each other longitudinally and having respectively a third (PL) and a second (PC) different values of the longitudinal pitch, and consequently a first and second equilibrium values of the transverse pitch;

each of said inductors consisting of the juxtaposition of several inductor sectors (BCi, Ei, BCi+1, EI+1) succeeding each other transversally and regularly according to said transverse pitch, each of said sections extending longitudinally and having its own inductor winding (Ei) and its own magnetic circuit (BCi) and having said frequency according to said longitudinal pitch (PC);

mechanical setting mechanisms (61, 51*a*, 31*a*) controlling the spacing between said inductor sections (B1, E1) and consequently said transverse pitch (PT) to the same value in said two inductors (IL, IC) so as to adapt the device to limited variations in the width of the product to be heated through a variation in said spacing making said width (LA) equal to an integer number of transverse pitches thus making the edges of said product coincide with the edges of two said squares in each inductor so as to heat the edge areas of said product to the same temperature as the intermediate areas, said common transverse pitch being controlled between said first and second equilibrium values of the transverse pitch;

an electrical setting mechanism (RE) controlling the ratio of the electrical currents supplying the two inductors so that, when a difference between the real transverse pitch and its equilibrium value in each inductor tends to produce a local heterogeneity of heating specific to said inductor and supplying the two inductors (IL, IC) with the electric current required to cancel out the local global heating heterogeneity of the device by compensating the two heterogeneities specific to the two inductors.

2. Device according to claim 1, wherein the magnetic circuit of each of said sections (Bi, Ei), contains at least one longitudinal bar (Bi) carrying said pole pieces (P) succeeding each other longitudinally and protruding towards the products to be heated (7), a winding (Ei) specific to said bar, following a winding route passing longitudinally to the right of a first pole piece, then transversally between said pole piece and the second one, then longitudinally to the left of said second one, then transversally between said second one and a third, and so on, to provide an easy construction.

3. Device according to claim 2, wherein each section contains two of said bars (B1, B'1) installed on either side of the product to be heated (7).

4. Device according to claim 1, further comprising electric switches (I1, I2, I3, I4, I5) for connecting or disconnecting the windings (I1, E2, E3, E4, E5) exciting the lateral sections of the two inductors thus varying the number of transverse pitches to adapt the width of the heating flow to variations to the width of the product to be heated (7) larger than said limited variations.

5. In a heating process for flat products scrolling, through electro-magnetic induction, including the step of; causing the product to be heated (7) to scroll longitudinally in the magnetic flux of an inductor (IC) with a double frequency along a longitudinal pitch and along a transverse pitch, the improvement wherein said process further includes; causing the product to scroll successively in the magnetic flux of two successive inductors (IC, IL) with a common transverse pitch (PT) which is adjustable (31*a*) between two longitudinal pitches (PC, PL) of said two inductors, and setting said transverse pitch so that the width of said product coincides with an integer number of transverse pitches thereby obtaining the same heating on the two edge areas of said product as on the intermediate areas, and wherein said step of setting said transverse pitch comprises firstly setting the ratio of the currents supplying said two inductors to homogenize the heating in each transverse pitch and secondly adjusting the total power to reach the temperature required.

* * * * *